US005432323A

United States Patent [19]

Sopory

[11] Patent Number: 5,432,323

[45] Date of Patent: Jul. 11, 1995

[54] REGULATED ELECTRIC STRIP HEATER

[76] Inventor: Umesh K. Sopory, 38735 Adcock Dr., Fremont, Calif. 94536

[21] Appl. No.: 178,504

[22] Filed: Jan. 7, 1994

[51] Int. Cl.[6] ..... H05B 3/34

[52] U.S. Cl. ..... 219/548

[58] Field of Search ..... 219/548, 549, 504, 505; 338/22 R, 225 D

[56] References Cited

U.S. PATENT DOCUMENTS

| | | | |
|---|---|---|---|
| 3,971,416 | 7/1976 | Johnson | 138/33 |
| 3,987,318 | 10/1976 | Meijer | 338/225 D |
| 4,017,715 | 4/1977 | Whitney et al. | 219/553 |
| 4,312,121 | 1/1982 | Tweed | 29/611 |
| 4,314,145 | 2/1982 | Horsma et al. | 219/553 |
| 4,459,473 | 7/1984 | Kamath | 219/553 |
| 4,468,557 | 7/1984 | Bylin et al. | 219/535 |
| 4,574,188 | 3/1986 | Midgley et al. | 219/505 |
| 4,654,511 | 3/1987 | Horsma et al. | 219/548 |
| 4,721,848 | 1/1988 | Malone et al. | 219/504 |
| 4,791,276 | 12/1988 | Midgley et al. | 219/549 |
| 4,801,784 | 1/1989 | Jensen et al. | 219/548 |
| 4,954,696 | 9/1990 | Ishii et al. | 219/548 |
| 5,064,997 | 11/1991 | Fang et al. | 219/505 |
| 5,166,658 | 11/1992 | Fang et al. | 338/22 R |

*Primary Examiner*—Geoffrey S. Evans
*Attorney, Agent, or Firm*—Michael J. Hughes

[57] ABSTRACT

A strip heater (10) having at least one elongate control element (12*a*), at least one elongate heating element (12*b*) and a plurality of elongate conductors (14). An electrical insulator (18) partially encloses the elements (12) and the conductors (14). The elements (12) are physically separated and electrically connected by one of the conductors (14) such that both of the elements (12*a* and 12*b*) can be simultaneously placed in relative thermal contact with an object to be heated (19). An equally preferred alternate embodiment (310) has a dividing strip separating further separating the heating element (12*b*) from the control element (12*a*) and at a fixed distance such that the heating element (12*b*) is maintained generally parallel to the control element (12*a*).

18 Claims, 3 Drawing Sheets

REGULATED ELECTRIC STRIP HEATER

TECHNICAL FIELD

The present invention relates generally to the field of electrical heating elements and heating control devices and more particularly to an improved strip heating element. The predominant current usage of the improved regulated strip heater is in the heating of pipes, materials, substrates, and the like during industrial processing wherein these must be maintained at a relatively constant temperature.

BACKGROUND ART

Many industrial processes require that materials, such as liquid materials flowing through a pipe, be maintained at a relatively constant temperature. Elongate strip heaters are often utilized for such purposes. It has been common for such strip heaters to have metallic resistive heating elements, although heaters having flexible electrically conductive polymer elements provide superior characteristics for many applications. Generally, a strip heater may be constructed with a resistive polymer having two elongate conductors enclosed therein such that current flowing between the conductors creates Joules heat within the resistive material. A self regulating heater can be constructed using a positive temperature coefficient ("PTC") material, or a combination of PTC materials and zero temperature coefficient ("ZTC") materials, configured such that heating of the heater strip results in an increased total resistance and thus in a reduction of Joules heat. U.S. Pat. No. 4,654,511, issued to Horsma et al., teaches a method for utilizing several layers of PTC and/or ZTC materials to provide a characteristic temperature curve tailored to the application. By this means, the heater can be designed to optimize the heater for an application. For example, a high initial resistance (useful for limiting inrush current) can be obtained while only marginally sacrificing switching temperature characteristics.

Although there have been many useful variations in strip heater design, there remain applications in which it is desirable to have more precise temperature control and/or greater efficiency than is available through the use of known constructions. Furthermore, although the temperature curve characteristics of a strip heater can be controlled by use of known combinations of PTC and/or ZTC and/or negative temperature coefficient ("NTC") materials, even more precise control of such characteristics would be highly desirable.

To the inventor's knowledge, no prior art strip heater construction has provided highly accurate temperature control while also providing a great amount of heat, as may be required in applications requiring high temperatures and/or large volumes of materials. All prior art devices have either imprecisely monitored material temperature and/or have been incapable of providing sufficient heat for some applications. Also, to the inventor's knowledge, no prior art strip heater construction has provided the ability to precisely control switching temperature range and rate.

DISCLOSURE OF INVENTION

Accordingly, it is an object of the present invention to provide a strip heating element which can be regulated to maintain a precisely controlled material temperature.

It is another object of the present invention to provide a strip heating element which can heat to relatively high temperatures.

It is still another object of the present invention to provide a strip heating element which can heat relatively great quantities of materials.

It is yet another object of the present invention to provide a strip heating element which can be conformed to the shape of materials, pipes, and the like.

It is still another object of the present invention to provide a strip heating element which will operate over a wide temperature range.

It is yet another object of the present invention to provide a strip heating element which can be configured to reduce inrush current.

It is still another object of the present invention to provide a strip heating element which exhibits decreased voltage and thermal degradation.

It is yet another object of the present invention to provide a strip heating element which is economical to produce.

It is still another object of the present invention to provide a strip heating element which is durable and reliable in operation.

It is yet another object of the present invention to provide a strip heating element which will function properly where very long strip heater lengths are required.

Briefly, the preferred embodiment of the present invention is a strip heater having a resistive heating element and a control element. The heating element is electrically and mechanically connected, using an electrically conductive adhesive, between substantially the entire length of two generally parallel elongate conductors. The second control element is similarly affixed between a third elongate conductor and one of the conductors which is also affixed to the heating element. An equally preferred alternate embodiment of the present invention has four elongate conductors with two electrically and mechanically affixed to the heating element and the other two electrically and mechanically affixed to the control element. There is no direct mechanical connection between the heating element and the control element in either embodiment and, in the case of the equally preferred alternate embodiment, there is no internal electrical connection between the heating element and the control element—although an electrical connection can be made externally, as will be discussed in relation to the industrial applicability of the invention. The equally preferred alternate embodiment of the invention has an elongate dividing strip connected between the heating element and the control element such that the control element is held generally parallel to the heating element.

The inventor has found that much of the inability to accurately control material temperatures using conventional technology has resulted from the fact that the relationship of heating elements to control elements found in the prior art has caused the control element to be unduly influenced by the temperature of the heating element, rather than by the temperature of the material to be heated. The present invention substantially corrects this problem and, further, increases the efficiency and accuracy of control by reducing interface resistance between the elements. Finally, the present invention allows for the use of external control elements to supplement the self regulating attributes of the strip heater, to provide even more precise temperature control.

An advantage of the present invention is that the control element is not unduly influenced by the heating element, and therefore the temperature of a heated object or material can be more precisely detected and controlled.

A further advantage of the present invention is that unwanted interface resistance is reduced, and thus heating efficiency and controllability is improved.

Yet another advantage of the present invention is that external control can be added to supplement the inherent temperature control provided by the control element, thereby precisely tailoring the switch on and switch off temperatures and switching rates.

Still another advantage of the present invention is that it is economical to produce.

Yet another advantage of the present invention is that the heating element can be made quite thick without changing the control characteristics of the heater, thereby allowing for a greater production of heat and lesser deterioration due to voltage and heat.

These and other objects and advantages of the present invention will become clear to those skilled in the art in view of the description of the best presently known modes of carrying out the invention and the industrial applicability of the preferred embodiments as described herein and as illustrated in the several figures of the drawing.

BEST MODE FOR CARRYING OUT INVENTION

The best presently known mode for carrying out the invention is an improved regulated strip heater having mechanically separate elements. The predominant expected usage of the inventive improved regulated strip heater is in industrial processing facilities, particularly in those applications wherein accurately temperature controlled heating of large or irregularly shaped objects, pipes, vessels, or the like is required.

Figure 1:
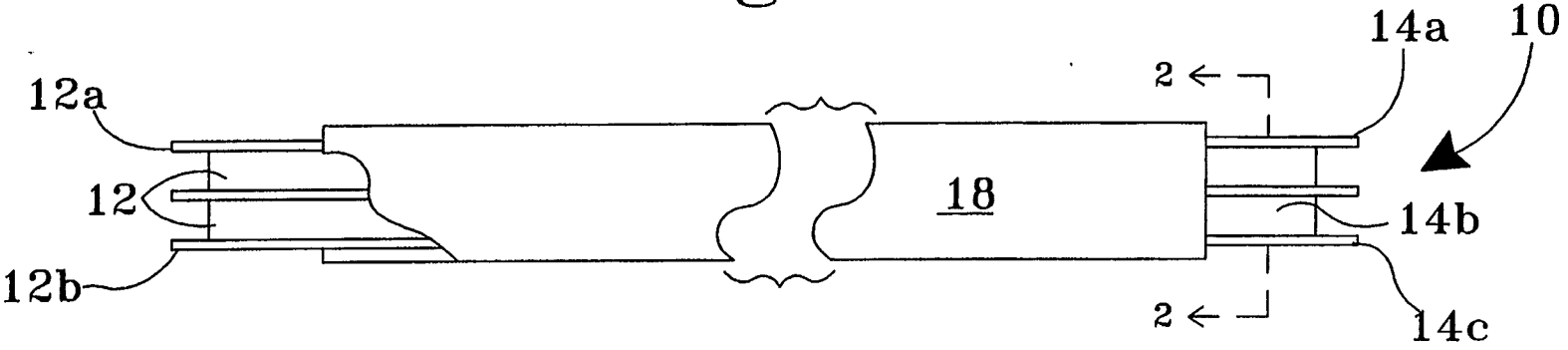
FIG. 1 is a partially cut away top plan view of an improved regulated strip heater according to the present invention.

The improved regulated strip heater of the presently preferred embodiment of the present invention is illustrated in a partially cut away top plan view in FIG. 1 and is designated therein by the general reference character 10. In many of its substantial components, the improved regulated strip heater 10 does not differ significantly from conventional self regulating strip heaters. The best presently known embodiment 10 of the present invention has two elements 12, a control element 12*a* and a heating element 12*b*. The heating element 12*b* of the best presently known embodiment 10 of the present invention is constructed of a ZTC resistive polymer, although other electrically resistive materials might be utilized, provided that such material must withstand repeated Joules heating, and further provided that such material must be sufficiently flexible to be wrapped around a pipe or the like where the application requires. Furthermore, as will be discussed in more detail hereinafter, the heating element 12*b* may, for some applications, be made of an NTC material, and PTC material, or even an electrically insulative material. Similarly, the control element 12*a* of the best presently known embodiment 10 of the present invention is made from a PTC polymer material, although any material which changes resistance as a function of temperature (even an NTC material, as will be discussed in more detail hereinafter) might be employed for the purpose, provided that the durability and flexibility are also suited to the particular application. The availability of such materials as are used in the construction of the best presently known embodiment 10 of the invention, and their characteristics as used singly or in combination, are well known in the prior art. For example, the previously cited Horsma '511 patent addresses these material characteristics in detail.

As can be seen in the view of FIG. 1, the best presently known embodiment 10 of the present invention has three elongate conductors 14. A first conductor 14*a* and a second conductor 14*b* are generally parallel to each other and are affixed along opposing sides of the control element 12*a*. A third conductor 14*c* is generally parallel to the first and second conductors 14*a* and 14*b*, and the heating element 12*b* is affixed between the third conductor 14*b* and the second conductor 14*c*. In the best presently known embodiment 10 of the present invention, the conductors 14 are copper wire, although any flexible conductive material, such as a fiberglass rope impregnated with a conductive substance, might be employed for the purpose. Indeed, in some applications, it might be appropriate that one or more of the conductors 14 be less than highly electrically conductive such that a significant portion of the Joules heat is produced within the conductors 14 themselves, as will be discussed in more detail hereinafter in relation to the industrial applicability of the invention.

Figure 2:
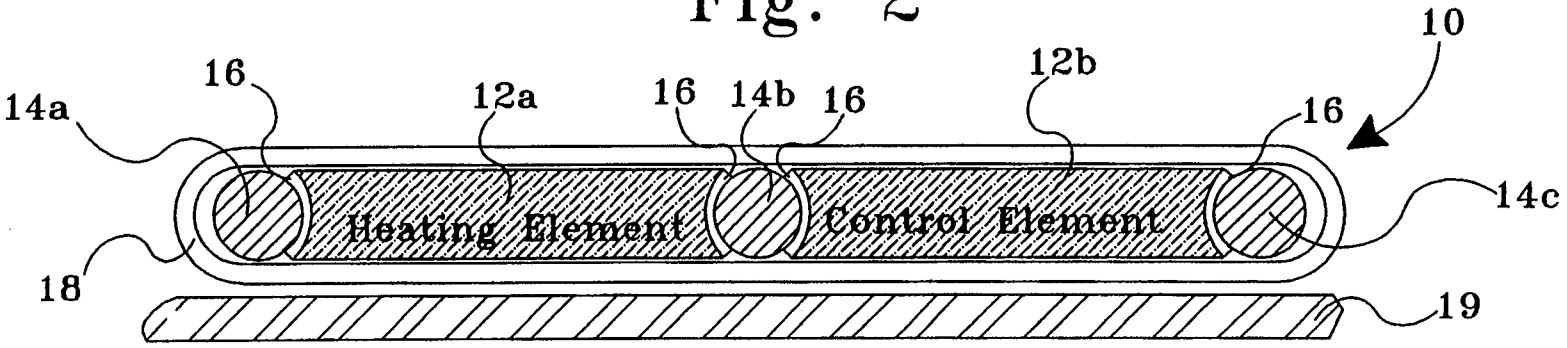
FIG. 2 is a cross sectional view of the improved strip heater, taken along line 2—2 of FIG. 1.

FIG. 2 is a cross sectional view of the best presently known embodiment 10 of the present invention, taken along line 202 of FIG. 1. In the view of FIG. 2, it can be seen that the control element 12*a* and the heating element 12*b* are generally flat strips formed such that the conductors 14 fit the edges thereof. Although the conductors 14 as depicted in FIG. 2 are generally round in cross section, this shape is not necessary to the invention. Indeed, for example, the outer conductors 14*a* and 14*c* might be round while the second conductor 14*b* could be generally rectangular in cross section, with appropriate modification of the cross sectional aspect of the elements 12. In the best presently known embodiment 10 of the present invention the elements 12 are affixed to the conductors 14 by means of a high temperature electrically conductive adhesive 16. The elements 12 may be extruded with the conductors 14 embedded during the extrusion process or, alternatively, the conductors 14 may be affixed to the elements 1 after the elements 12 are formed by extrusion, molding or other process. The best presently known embodiment 10 of the present invention is constructed by separately extruding the elements 12 and then affixing the conductors 14 thereto using the adhesive 16, although the inventive structure is not limited by this manufacturing method. The improved regulated strip heater 10 could also be constructed by heat bonding the conductors 14 to the elements 12, or by extruding the elements 12 around some or all of the conductors 14, or the like. An additional advantage of the method here described as resulting in the best presently known embodiment 10 of the present invention is that, when the conductors 14 and the elements 12 are separately manufactured, it will be possible to quickly and easily produce a great variety of variations of the premanufactured conductors 14 and elements 12.

An electrical insulator 18 encloses the conductors 14 and the elements 12 (leaving the ends exposed for connection thereto). The insulator be must be electrically nonconductive and yet must readily transfer heat to and from the elements 12. The insulator 18 might be molded or extruded over the elements 12 and the conductors 14. However, in the best presently known embodiment 10 of the present invention, the insulator 18 is manufactured in the form of a sleeve and the elements 12 and conductors 14 (already joined together as described previously herein) are inserted therein.

An object 19 to be heated by the inventive strip heater 10 is also shown in FIG. 2, in order to illustrate that the best presently known embodiment 10 of the present invention is intended to be applied to the object 19 such that both the control element 12*a* and the heating element 12*b* are separately in relative thermal contact with the object 19. That is, the heating element 12*b* is adjacent to the object to be heated 19, being separated only by the thermally conductive electrical insulator 18, as is the control element 12*a*. Therefore, the object to be heated 19 can be heated by the heating element 12*b* while the control element 12*a* senses the temperature of the object to be heated 19, yet the amount of direct thermal interaction between the heating element 121 and the control element 12*a* is limited.

Figure 3:
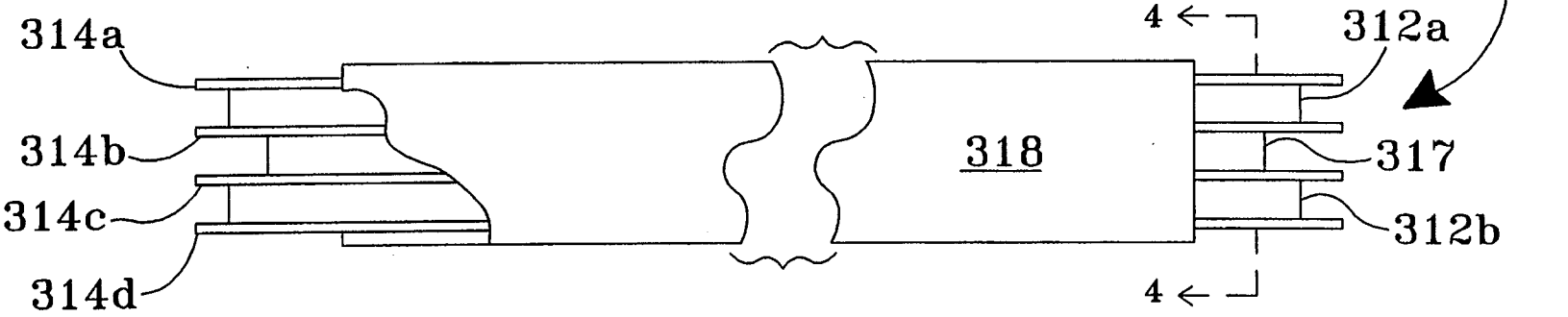
FIG. 3 is a partially cut away to plan view of an equally preferred alternate embodiment of the inventive regulated strip heater.

FIG. 3 is a partially cut away top plan view of an equally preferred alternate embodiment 310 of the present invention. The equally preferred alternate embodiment 31 has a control element 312*a* and a heating element 311*b* not unlike the corresponding elements 12*a* and 12*b* of the first preferred embodiment 10. The equally preferred alternate embodiment 310 of the invention has four conductors 314, with a first conductor 314*a* and a second conductor 314*b* electrically and mechanically affixed along the edges of the control element 312*a*, and with a third conductor 314*c* and a fourth conductor 314*d* electrically and mechanically affixed along the edges of the heating element 312*b*.

Figure 4:
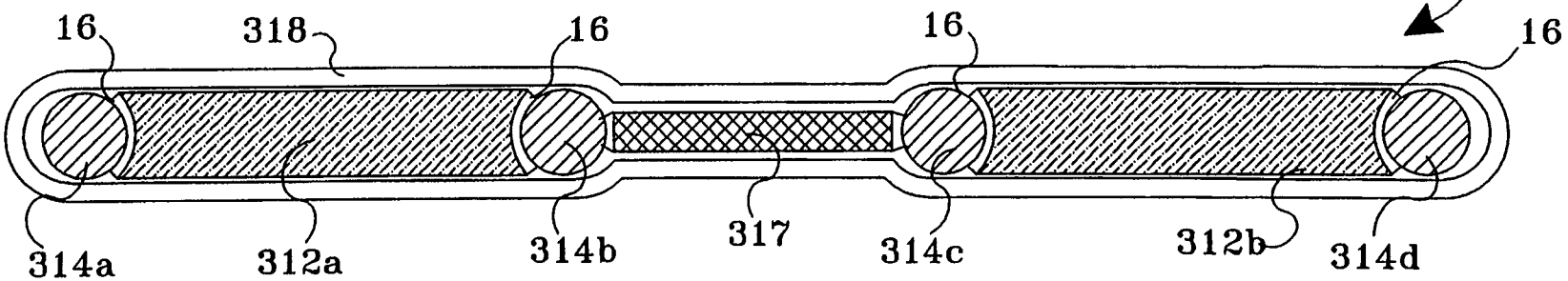
FIG. 4 is a cross sectional view of the alternate embodiment of the regulated strip heater, taken along line 4—4 of FIG. 3.

FIG. 4 is a cross sectional view of the equally preferred alternate embodiment 310, taken along line 4—4 of FIG. 3. As can be seen in the view of FIG. 4, the elements 312 are formed and connected to the conductors 314 in like manner as discussed previously herein in relation to the elements 12 and conductors 14 of the first preferred embodiment 10 of the present invention. In both the view of FIG. 3 and the view of FIG. 4 an optional dividing strip 317 is affixed between the second conductor 314*a* and the third conductor 314*b*. The dividing strip 317 maintains the control element 312*a* and a fixed distance from the heating element 312*b* such that the control element 312*a* will be close enough to the heating element 312*b* to prevent undue lag time in sensing temperature changes caused by the heating element 312*b*, yet far enough away from the heating element 314*b* to accurately detect the temperature of the object being heated, rather than just the temperature of the heating element 314*b*. The appropriate width for the dividing strip 317 can be determined by experimentation according to the type of application for which the equally preferred alternate embodiment 310 of the invention is intended. It is anticipated that, for most applications, the dividing strip 317 will position the second conductor 312*b* and the third conductor 312*c* on the order of from a few millimeters to a few centimeters apart.

As previously mentioned, the dividing strip 317 is optionally provided, and the invention can be practiced without it. The dividing strip 317 merely provides a convenient means for keeping the elements 312 apart at the required distance. Were the invention to be practiced without the dividing strip 317, the elements 312 could be placed apart at the desired distance by the end user. Indeed, there might well be some advantage in omitting the dividing strip 312 for some applications, since the distance between the elements 312 could be more readily varied according to the application if the elements 312 were not physically connected along their lengths. Yet another variation might be to replace the dividing strip 317 with a removable tape, or the like (not shown) which would keep the elements 312 apart at a fixed distance as they were being applied, and then would be removed after installation. The same advantage could be had by making the dividing strip 317 easily detachable form the elements 312. Generally, the dividing strip 317, where provided, wi1ll be of an electrically and thermally insulative material, although it is possible that there may be applications where it might be desirable to have the dividing strip 317 made from an electrically and/or thermally conductive, or semi-conductive, material. Indeed, in some applications it might be desirable to have the dividing strip 317 constructed from a PTC material, an NTC material or a ZTC material. The desirability for such a variation will be better understood in light of the discussion of the industrial applicability of the invention, hereinafter.

An electrical insulator 318 partially encloses the conductors 314 and the elements 312. The insulator 318 is alike in materials and properties to the insulator 18 previously discussed herein in relation to the best presently known embodiment 10 of the present invention.

As is shown above, in great part, the improved regulated strip heaters 10 and 320 according to the present invention are similar in many respects to conventional strip heaters. Among the substantial differences are physical separation of the control elements 12*a* and 312*a* from the heating elements 12*b* and 312*b*, and the overall configuration of the elements 12 and 312 such that the control elements 12*a* and 312*a* are not unduly affected by the heating elements 12*b* and 312*b*. The materials and construction methods needed to practice there present invention are not significantly different than those known in the prior art.

Various modifications may be made to the invention without altering its value or scope. For example, while the present invention has been illustrated herein by embodiments 10 and 310 having two elements 12, 312 each, it is known in the prior art to provide more than two elements in combinations of NTC and/or PTC and/or ZTC to produce a desired temperature characteristic curve, and this extension of the prior art might be equally applied to the present invention.

All of the above are only some of the examples of available embodiments of the present invention. Those skilled in the art will readily observe that numerous other modifications and alterations may be made without departing from the spirit and scope of the invention. Accordingly, the above disclosure is not intended as limiting and the appended claims are to be interpreted as encompassing the entire scope of the invention.

INDUSTRIAL APPLICABILITY

The improved regulated strip heater is intended to be widely used in industrial processing. The predominant current usages are for heating pipes and tanks during liquid chemical processing. The inventive strip heaters might be employed wherever conventional strip heaters are used and, due to the versatility of connection of the present invention, it is anticipated that many new applications will be forthcoming. In order to illustrate some of the advantages provided by the present invention, FIG. 5 is a diagrammatic representation of potential electrical configurations of the best presently known embodiment 1 and the equally preferred alternate embodiment 312 of the present invention.

Figure 5:
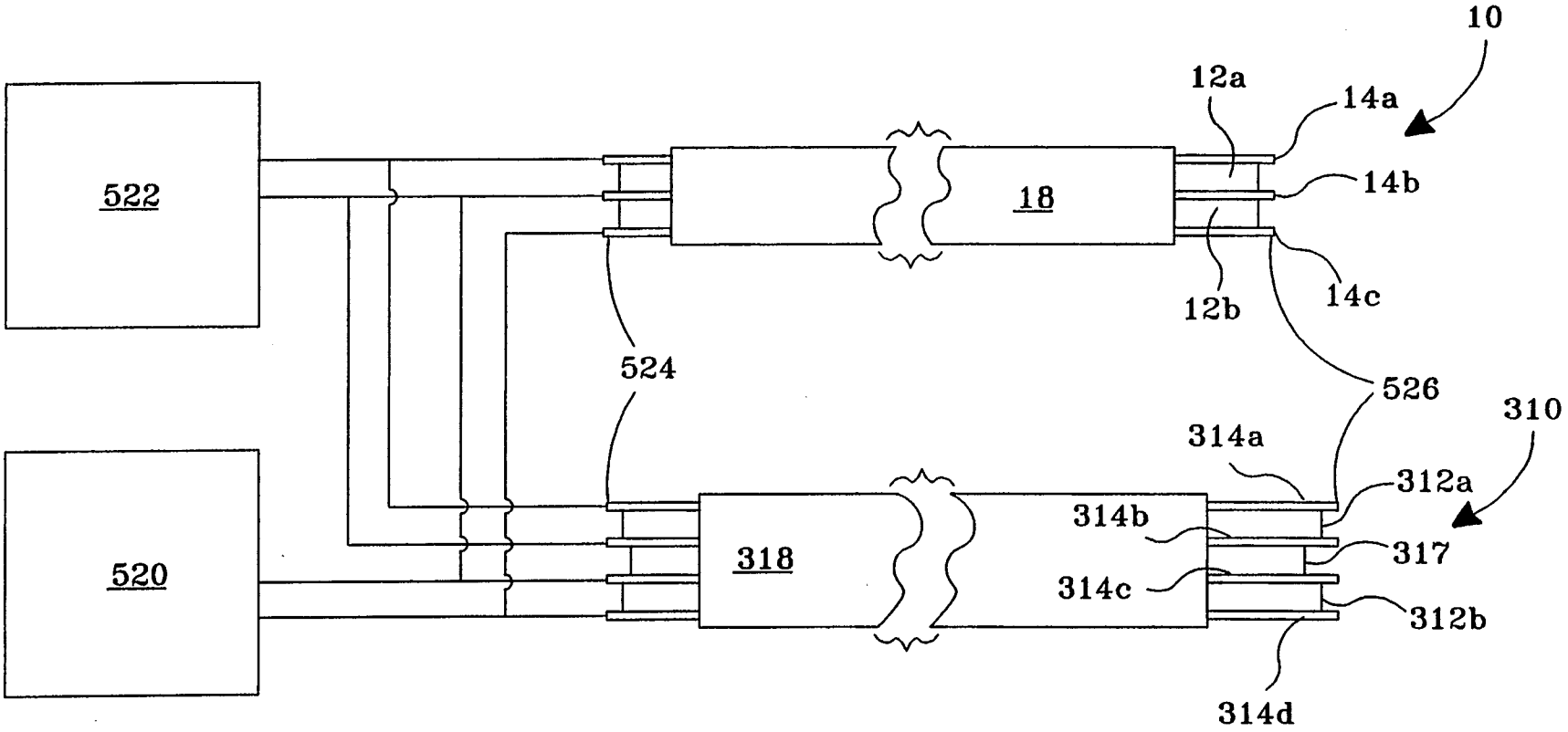
FIG. 5 is an example of alternative electrical connections to the inventive strip heaters.

Illustrated in the diagram of FIG. 5 are a power supply 520 and a control unit 522. The control unit 522 is a conventional thermostat type device which, when used in conjunction with the present inventive self regulating strip heaters 10 and 310 as discussed herein, will provide the user with the most desired advantages of a conventional self regulating strip heater (such as the proximity of sensors to the heated area and the fact that both the heating elements and the sensors can be run along or around a pipe for its entire length) with the most desired advantages of an externally regulated heater (such as the precision of temperature control, the fact that the minimum temperature and/or peak temperature and/or temperature range may each and all be adjusted and readjusted as required, and the fact that the turn on and turn off characteristics can be more readily tailored to the application).

It should be noted that the controller is not necessary to the operation of the present inventive strip heaters 10 and 310. Rather, the inventive strip heaters 10 and 310, when used in an entirely self regulated mode in the manner of conventional self regulating strip heaters, will provide the several advantages previously discussed herein, such as the thermal distancing of the control elements 12*a*, 312*a* from the heating elements 12*b*, 312*b*. The examples of application configurations illustrated in FIG. 5 and discussed hereinafter provide yet more advantages which can be derived due to the unique construction of the present invention.

When provided, the controller 522 is electrically connected to and capable of controlling, switching or limiting voltage and/or current provided from the power supply 520 to the heaters 10 and 310. For purposes of this example, each of the herein described embodiments 10 and 310 of the present invention has designated in FIG. 5 a near end 524 (to be connected to the control unit 522 and/or the power supply 520) and a far end 526. The power supply 520 can be line voltage AC (120 v or 220 v two wire), or any other appropriate source having the capability of supplying sufficient current to produce the heat required. The control unit 522, when provided, will be a relatively simple electronic control device for responding to either the resistance of, or the current flowing through, or the voltage drop across, the control unit 522. In the example of FIG. 5, the power supply 520 and the control unit 522 are connected, as illustrated, to the strip heaters 10, 310 such that at least partially distinct electrical circuits are maintained relating to the control elements 12*a*, 312*a* and the heating elements 12*b*, 312*b* (with a common circuit portion, the second conductor 14*b*, forming a part of both paths in the case of the first presently preferred embodiment 10). The sort of application pictured in FIG. 5 might provide all of the several advantages of the present invention, including combining all of the advantages of a self regulating heater strip with those of a separately thermostatically controlled heater strip. Connected as illustrated in FIG. 5, the control elements 12*a* and 312*a* respond to temperatures along the entire lengths of the strip heaters 10 and 310—an advantage inherent in self regulating strip heaters, while also providing for the modification and further control of current flow through the heating elements 12*b* and 312*b* by means of the control unit 522 might serve simply to limit current flow so as to avoid excessive inrush current at turn on. Alternatively, the control unit 522 could be made more sophisticated so as to actually modify or shift the temperature response curve inherent in the control elements 12*a* and 312*a*.

It should be noted that electrical connections between the power supply 520 and the controller 522 are entirely conventional in nature and are omitted from the view of FIG. 5 for the sake of clarity.

The above is only one of a great many of configurations possible in practicing the present invention. For example, the power supply 520 could be connected between the first conductor 14*a* and the third conductor 14*c* of the best presently known embodiment 10 and the control unit 522 connected between the first conductor 14*a* and the second conductor 14*b*, thereby enhancing the self regulating aspect of the inventive configuration while still providing input to the control unit 522 such that the output of the power supply 520 can be limited or otherwise modified.

It should be noted that the present invention is not restricted to use with the control unit 522. For example, if the power supply were connected between the first conductor 14*a* and the third conductor 14*c* of the first preferred embodiment 10, the inventive self regulating strip heater 1 would act as does a conventional self regulating strip heater, with the additional advantages of having physically and, at least partially, thermally separated elements 12 such that better temperature sensing of the heated object 19 (FIG. 2) can be achieved, and also such that differential expansion and distortion of the two elements 12 does not cause undue breakdown of the interface therebetween (there being no direct physical interface) thereby eliminating a primary source of failure found in conventional strip heaters. This same sort of configuration could be applied by connecting the power supply 520 between the first conductor 314*a* and the fourth conductor 314*d* of the equally preferred alternate embodiment 310 while electrically connecting the second conductor 312*b* and the third conductor 312*c* together.

Yet another variant application in which either the first preferred embodiment 10 or the alternative embodiment 310 of the invention might be employed would be to construct the conductors 14 or 314 adjacent to the heating element 121 or 312*b* from a resistive material such that those conductors 14 or 314 would contribute to the creation of Joules heat. An example of this type of application would entail shorting together the third and fourth conductors 314*c* and 314*d* of the equally preferred alternate embodiment 310 of the invention while retaining any of the above discussed alternative connections to the strip heater 310 from the power supply 521 and the thermostat 522 (if the thermostat 522 is used). As can be appreciated, this would essentially short across the power supply 520 unless the third and fourth conductors 314*c* and 314*d* were constructed of a resistive material. A variation within this variation would be to construct the heating element 312*b* from an electrically insulative material such that essentially all of the Joules heat would be created in the third and fourth conductors 314*c* and 314*d* (with the exception of that incidentally created by any current flowing through the control element 312*a*).

Since the improved regulated strip heaters of the present invention may be readily constructed and are physically significantly similar to prior art conventional strip heaters, it is expected that they will be acceptable in the industry as substitutes for the conventional strip heaters. For these and other reasons, it is expected that the utility and industrial applicability of the invention will be both significant in scope and long-lasting in duration.

We claim:

1. An electrical heating device for heating an object, comprising:

a elongate control element having an electrical resistance that varies as a function of temperature;

an elongate electrical heating element;

electrical current supply means for providing an electrical current through said heating element; and a plurality of electrical conductors for providing a first electrical path through said control element and further for providing a second electrical path through said heating element, the first electrical path being at least partially distinct from the second electrical path;

an electrical insulator at least partially enclosing said electrical heating element, said control element and said plurality of electrical conductors, wherein;

said elongate heating element and said elongate control element have a generally flat cross section such that said elongate heating element and said elongate control element may be positioned side by side with said elongate heating element in good thermal contact with the object and further with said elongate control element in good thermal contact with the object.

2. The electrical heating device of claim 1, wherein:

said control element is formed from a positive temperature coefficient material.

3. The electrical heating device of claim 1, wherein:

said elongate heating element and said elongate control element have a generally flat cross section such that said elongate heating element and said elongate control element may be positioned side by with both said elongate heating element and said elongate control element in close thermal proximity to the object and with the electrical insulator interposed between said elongate heating element and the object and between said elongate control element and the object.

4. The electrical heating device of claim 1, wherein:

said plurality of electrical conductors are elongate and are affixed along the length of said control element and said heating element such that a first pair of conductors is affixed along the length of opposing sides of said control element and a second pair of conductors is affixed along the length of opposing sides of said heating element.

5. The electrical heating device of claim 4, wherein:

One of said conductors of the first pair of conductors is common with one of said conductors of the second pair of conductors such that the quantity of conductors is three.

6. The electrical heating device of claim 1, wherein:

one or more of said plurality of conductors is resistive such that current passing therethrough will produce within said plurality of conductors at least one tenth portion of the total amount of heat produced by the electrical heating device.

7. The electrical heating device of claim 1, wherein:

said heating element is constructed of a positive temperature coefficient material.

8. The electrical heating device of claim 1, wherein:

said heating element is constructed of a zero temperature coefficient material.

9. The electrical heating device of claim 1, wherein:

said heating element is constructed of an electrically insulative material.

10. An electric strip heater, comprising:

an elongate heater element having a first elongate heater conductor and a second elongate heater conductor affixed along opposed sides of said heater element; and an elongate control element having a first elongate control conductor and a second elongate control conductor affixed along opposed sides of said control element; wherein the first elongate heater conductor and the second elongate heater conductor are electrically and mechanically connected to said elongate heater element along generally the entire length of said elongate heater; and the first elongate control conductor and the second elongate control conductor are electrically and mechanically connected to said elongate control element along generally the entire length of said elongate control element;

said control element is physically partitioned from said heater element along generally the entire length of said control element and said heater element.

11. The electric strip heater of claim 10, wherein:

said first elongate heater conductor and said first elongate control conductor are constructed as unitary elongate conductor; and the unitary elongate conductor partitions said heater element from said control element.

12. The electric strip heater of claim 10, wherein:

the first elongate heater conductor and the second elongate heater conductor are affixed to said heater element with an electrically conductive adhesive; and the first elongate control conductor and the second elongate control conductor are affixed to said control element with an electrically conductive adhesive.

13. The electric strip heater of claim 10, wherein:

said heater element is formed such that the first elongate heater conductor and the second elongate heater conductor fit at least partially within and are closely supported by the edges of said heater element; and said control element a is formed such that the first elongate control conductor and the second elongate control conductor fit at least partially within and are closely supported by the edges of said control element.

14. The electric strip heater of claim 10, and further including:

an elongate dividing strip interposed between said heater element and said control element and running substantially the length of said heater element and said control element such that said heater element is held generally parallel to and at a fixed distance from said control element along the length of the dividing strip, the fixed distance being generally the width of the dividing strip.

15. The electric strip heater of claim 14, wherein:

the dividing strip is constructed of an electrically conductive material.

16. The electric strip heater of claim 14, wherein:

the dividing strip is constructed of an electrically resistive material.

17. The electric strip heater of claim 14, wherein:

the dividing strip is constructed of a temperature sensitive material such that the electrical resistance of the dividing strip varies as a function of the temperature of the dividing strip.

18. The electric strip heater of claim 14, wherein:

the dividing strip is directly affixed along the lengths of and between the first elongate heater conductor and the first elongate control conductor such that the first elongate heater conductor is interposed between the dividing strip and the heater element and the first elongate control conductor is interposed between the dividing strip and the control element.

* * * * *